US008408682B2

(12) United States Patent
Platt et al.

(10) Patent No.: US 8,408,682 B2
(45) Date of Patent: Apr. 2, 2013

(54) HEAT SEALEABLE FILTER TO ENABLE VACUUM SEALING OF PARTICLE GENERATING INSULATIONS

(75) Inventors: David Paul Platt, Newberg, OR (US); Joseph Andrew Broderick, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 308 days.

(21) Appl. No.: 12/764,895

(22) Filed: Apr. 21, 2010

(65) Prior Publication Data

US 2011/0261122 A1 Oct. 27, 2011

(51) Int. Cl.
*B41J 2/05* (2006.01)

(52) U.S. Cl. ..... 347/67; 347/56; 347/61; 347/88

(58) Field of Classification Search ..... 347/56, 347/61, 67, 88; 428/68, 69, 72, 74, 76; 220/592.2
See application file for complete search history.

(56) References Cited

U.S. PATENT DOCUMENTS 4,136,222 A * 1/1979 Jonnes ..... 428/116
6,902,256 B2 * 6/2005 Anderson et al. ..... 347/56
2002/0187278 A1 * 12/2002 Watanabe et al. ..... 427/525
2006/0227191 A1 * 10/2006 Williams et al. ..... 347/88
2008/0252691 A9 * 10/2008 Silverbrook ..... 347/54
2009/0179541 A1 * 7/2009 Smith et al. ..... 312/406
2010/0245452 A1 * 9/2010 Platt et al. ..... 347/17
2011/0117308 A1 * 5/2011 Hiemeyer et al. ..... 428/69

* cited by examiner

*Primary Examiner* — Matthew Luu
*Assistant Examiner* — Rut Patel
(74) *Attorney, Agent, or Firm* — Marger Johnson & McCollom PC

(57) ABSTRACT

An insulation container has an insulation material, a filter arranged to encase the insulation material, the filter of a material that prevents escape of the insulation material while allowing air to pass through, and a container arranged to encase the filter, the container being heat sealable. A printer has an ink supply, a print head arranged to receive ink from the ink supply and configured to receive electrical signals from a controller and to dispense ink in accordance with the electrical signals onto a print substrate, and an insulator to absorb heat from the print head. A method of manufacturing an insulator includes forming a filter container of a filter material, the filter material having openings small enough to prevent escape of the filter material and large enough to allow air to pass through, filling, at least partially, the filter container with an insulating material, sealing the filter container, inserting the filter container into a sealable container, applying a vacuum to the sealable container such that the vacuum is applied to the filter container as well, and sealing the sealable container.

7 Claims, 5 Drawing Sheets

HEAT SEALEABLE FILTER TO ENABLE VACUUM SEALING OF PARTICLE GENERATING INSULATIONS

BACKGROUND

Thermal management in electronic devices presents critical issues. High heat environments generally degrade the performance and efficiency of electronic devices, resulting in higher power consumption. Additionally, the heat generated by the devices can cause the environment around them to have higher temperatures, requiring more energy to cool them. For entities desiring to obtain efficiencies ratings, such as the EnergyStar® endorsements, the management of the heat becomes a critical issue.

One approach to thermal management uses thermal insulators in the devices to absorb and contain the heat generated by the devices. Aerogels perform very well as thermal insulators. An aerogel generally consists of a manufactured material derived from a "gel", but where air or other gas replaces the liquid component of the gel. The resulting aerogel solid has very low density riddled with nanopores near the mean free path of air molecules, trapping them, stopping heat transfer (or other energy transfer) between them. It generally feels dry and rigid to the touch, but has very high effectiveness as a thermal insulator. Silica based aerogels in particular make very efficient thermal insulators as they are 95-99.8% air and the remainder is the silica nanostructure.

Aerogels generally perform better after application of a vacuum prior to heat sealing the insulation 'bag' or container. However, vacuum sealing aerogel-based insulation often fails. Upon application of the vacuum, the aerogel produces particles that enter the vacuum stream and contaminate the heat seal. The resulting heat seal either does not seal or will not hold upon usage. While one could use the insulating materials without using a vacuum, these materials work far more effectively if they undergo a vacuum

DETAILED DESCRIPTION OF THE EMBODIMENTS

Figure 1:
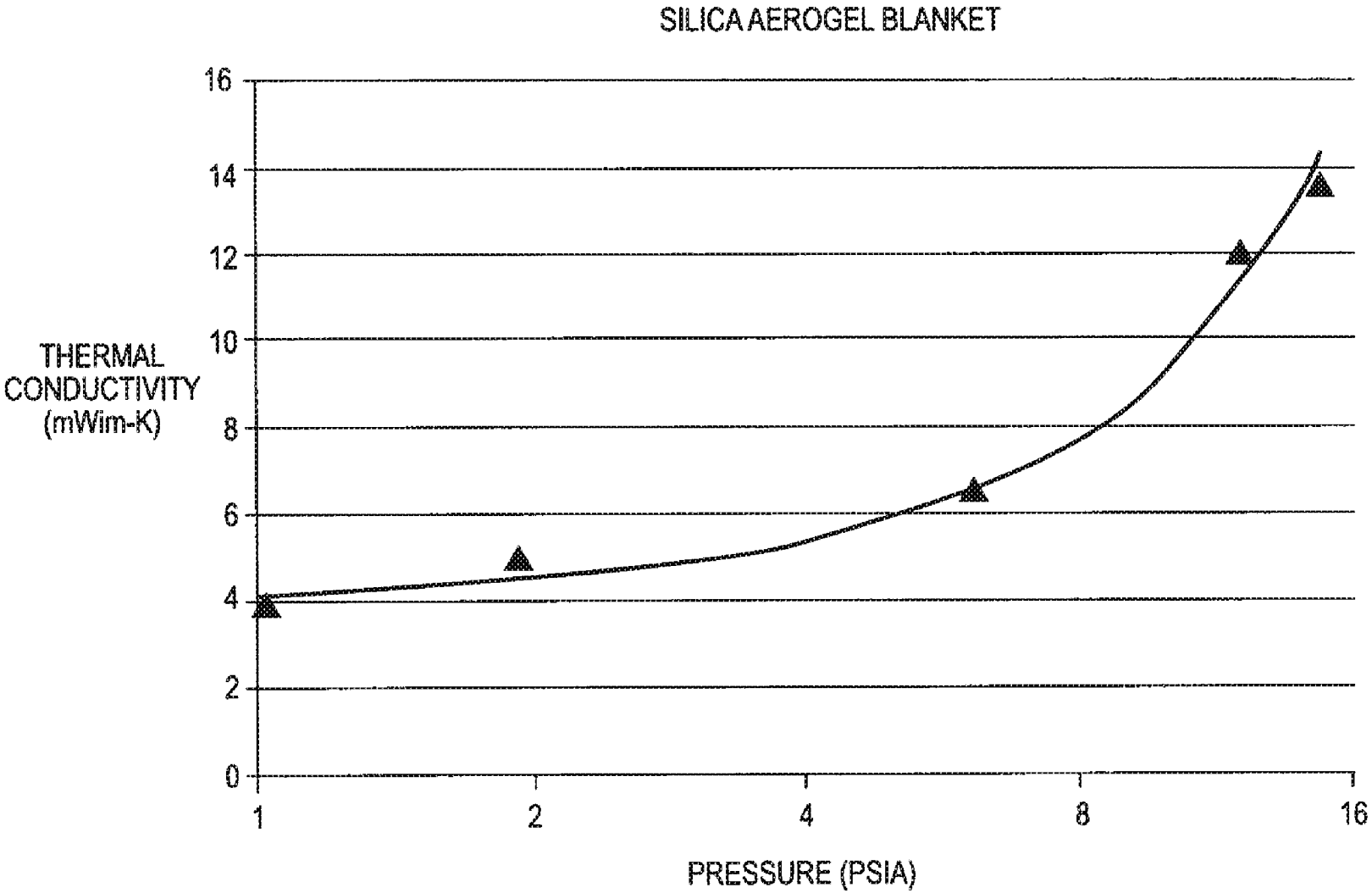
FIG. 1 shows a graph of silica aerogel blanket thermal conductivity in various vacuum pressures.

Several advantages exist in the use of aerogels as insulating materials. These materials have very good thermal conductivity and users can shape or mold them to a desired shape in many instances. When one applies a vacuum to the silica aerogel, the thermal conductivity decreases as shown in FIG. 1. As can be seen by the curve 10, by applying a vacuum of 0.2 psia, one can decrease the thermal conductivity more than three times what it would be without a vacuum.

Figure 2:
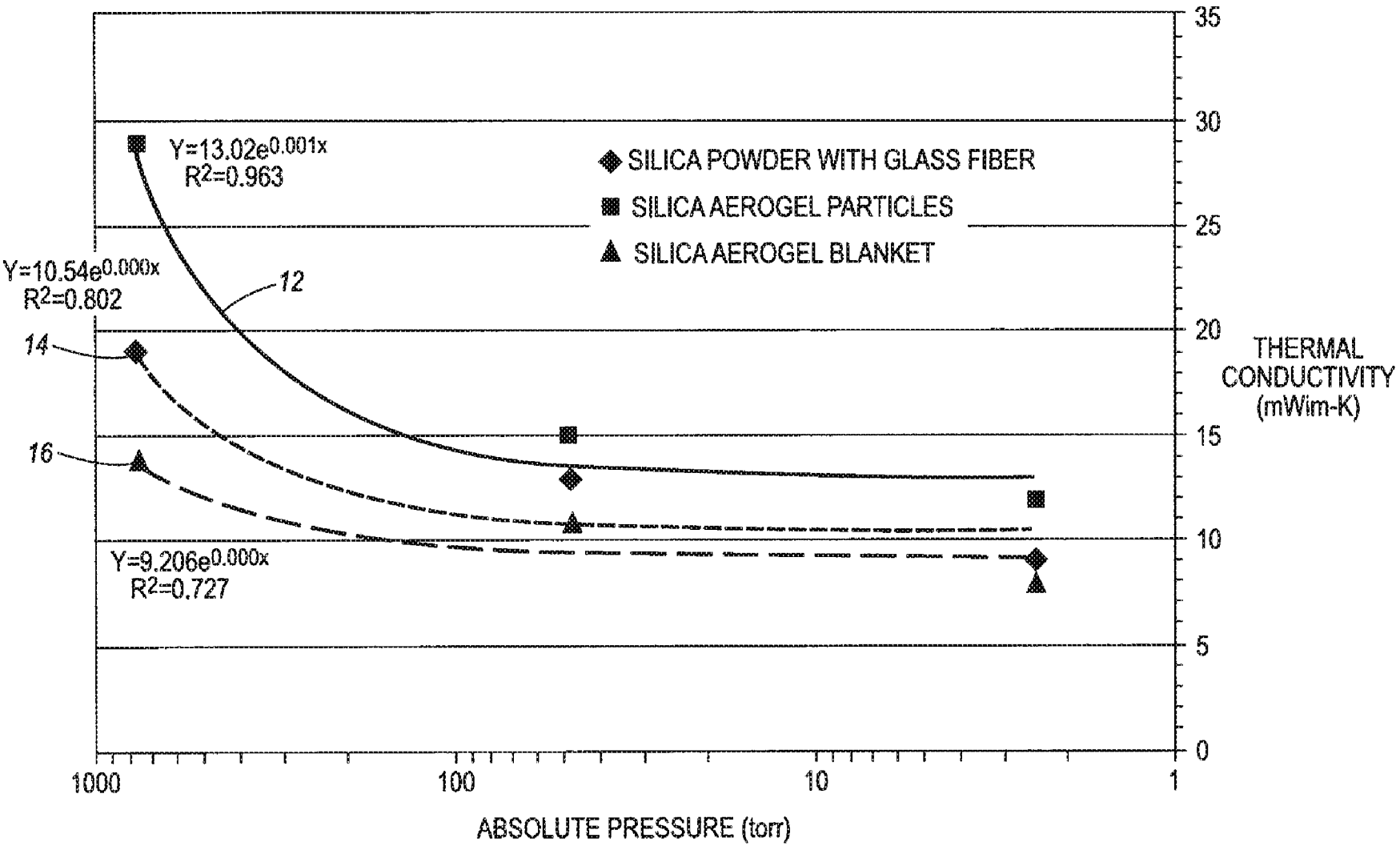
FIG. 2 shows a graph of thermal conductivity of various silica based materials in vacuums of various pressures.

A more material specific graph is shown in FIG. 2. Different types of aerogels have different thermal conductivities at various pressures. This graph expresses pressure in Ton, where 760 ton is equivalent to 1 atmosphere. Curve 12 shows the thermal conductivity at various pressures for silica aerogel particles. An example material would be Nanogel™ by Cabot. Curve 14 shows the data for a silica powder mixed with glass fibers. An example of this type of material would be Microsil™ thermal ceramic from ZIRCAR Ceramics. Curve 16 shows the data for a silica aerogel that is generally mixed with reinforcing fibers and formed into a blanket, such as Spaceloft™ by Aspen Aerogels.

The data associated with the graph is given in the following table:

| | Thermal Conductivity (mW/m-K) | | |
|---|---|---|---|
| Material | 760 torr | 48 torr | 2.5 torr |
| Silica Aerogel blanket | 14 | 11 | 8 |
| Silica powder with glass fibers | 19 | 13 | 9 |
| Silica aerogel particles | 29 | 15 | 12 |

The use of a relatively high vacuum increases the effectiveness of aerogels with regard to their thermal conductivity. However, as discussed above, these materials generate a relatively high volume of particles when a vacuum is applied, resulting in contamination of the seal when the container, such as a bag, pouch, or container, is sealed.

Figure 3:
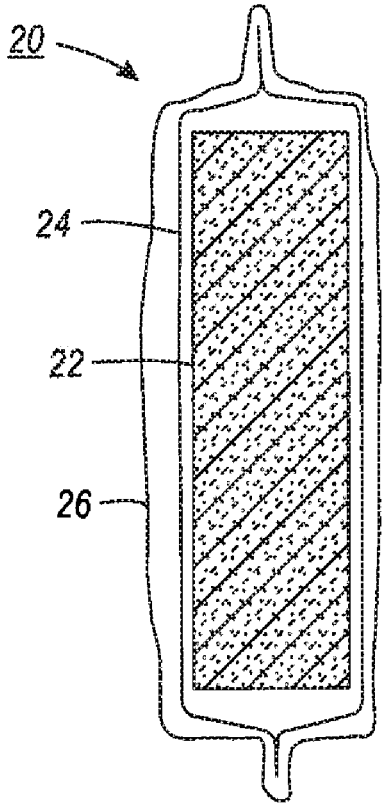
FIG. 3 shows a side view of an embodiment of an insulator inside a heat sealable container.

FIG. 3 shows an embodiment of an insulator that does not suffer from seal contamination. The insulator 20 uses a silica aerogel blanket or group of particles, examples of which are given above, or other insulation material 22. The insulation material is enclosed with a filter 24. The enclosure may be any container, such as bag or merely a piece of the filter material that hermetically wraps completely or partially around the insulation material. The filter has the characteristic to prevent particles of the insulation material from escaping the filter container while allowing air to pass through.

This filter is inserted or otherwise wrapped with a sealable material or container, such as a heat sealable bag. The bag or container may take any form, the only limitation being that it has to contain the filter and the material within the filter and be sealable. Once the filter and its enclosed insulation material are enclosed with the sealable container, a vacuum is applied. The container 26 is then sealed. Typically, this will be a heat seal, but other types of seals are of course possible, including adhesives, airtight fasteners or gaskets, etc. The main characteristic of the seal is that it be airtight, especially in the presences of a relatively high vacuum.

Figure 4:
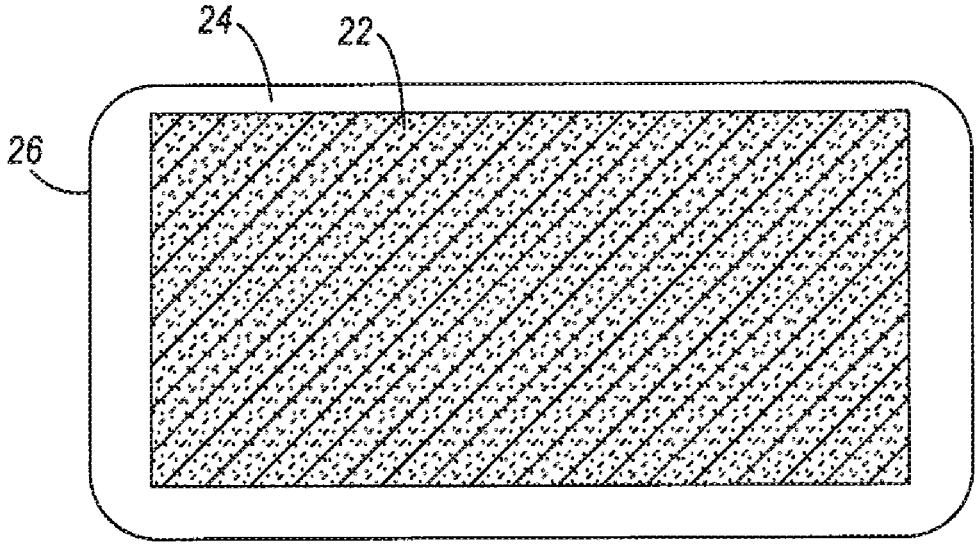
FIG. 4 shows a front view of an embodiment of an insulator inside a heat sealable container.

FIG. 4 shows a front view of an insulator. The sealable container 26 has within it, the filter material 24. The filter material contains the insulation material 22. In one embodiment, the filter material is a polyethylene terephthalate, or PET, mesh, where the mesh holes are selected to be small enough to prevent the aerogel or other material from escaping, but large enough to all air to pass through without clogging the filter. The air passage allows the application of the vacuum.

The application of this type of insulator may occur in many different environments, including buildings, vehicles, machinery, apparatus, and electronic or other devices that require thermal management. One particular example of these devices consists of a solid ink jet printer. Solid ink printers use an ink supply in the form of solid sticks of color or black. The printer melts the ink into a reservoir and then passes the ink to a print head. Generally, the conduits and the print head are themselves heated to prevent the ink from re-solidifying. These types of printers generate high levels of heat and thermal management becomes more important than in lower heat devices. The example of a printer is merely an example and is not intended to limit the claims or application of the embodiments in any way.

The printer 30 has an ink reservoir 36 into which the solid ink sticks will melt. A conduit 38 provides the ink to the print head 32. The print head 32 has a nozzle or aperture plate 34 that ejects ink onto a print substrate. A controller or processor 40 determines whether or not a particular nozzle ejects ink onto the print substrate, based upon image data. The pattern of drops of ink forms the desired image represented by the image data.

Figure 5:
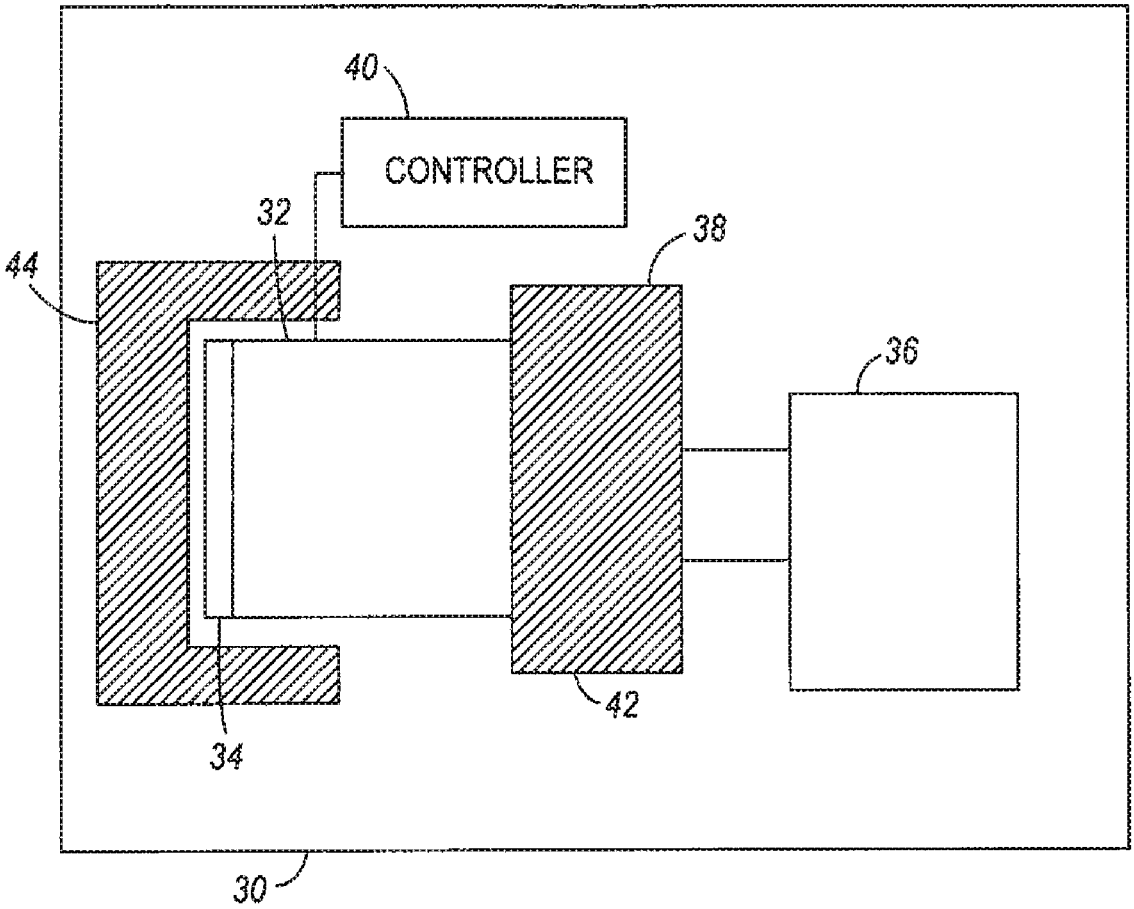
FIG. 5 shows a block diagram of a printer using an insulator.

As mentioned above, many of the components of solid ink printers are heated to keep the ink in its molten state, generating quite a bit of heat. Insulators become very important in managing the heat. In the example of FIG. 5, the insulation of the printer has two portions. A first portion 42, adjacent the print head 32, may reside in that position permanently. A second portion 44 may move into the position shown when the printer is in the sleep mode. During operation, the portion 44 may move up or down to allow the print head, which may move fore and aft (left or right with respect to the drawing), access to the print substrates.

While this is just an example of the insulation used in electronic devices, printer 30 does illustrate the use of insulation and highlights the need for good thermal conductivity within devices. Using silica aerogels in a vacuum provides that thermal conductivity. The embodiments here avoid the contamination of the seal that previously caused problems, allowing the seal to hold for much longer at higher vacuums.

Prior to using techniques discussed here, the aerogels generate a high volume of particles that get pulled into the vacuum stream and contaminate the surface of the sealing portions of the container. Once sealed, the seals did not work well, often failing in a matter of minutes. However, upon containing the insulation material in a filter and then sealing the filter into the container, the seals have held for months.

Figure 6:
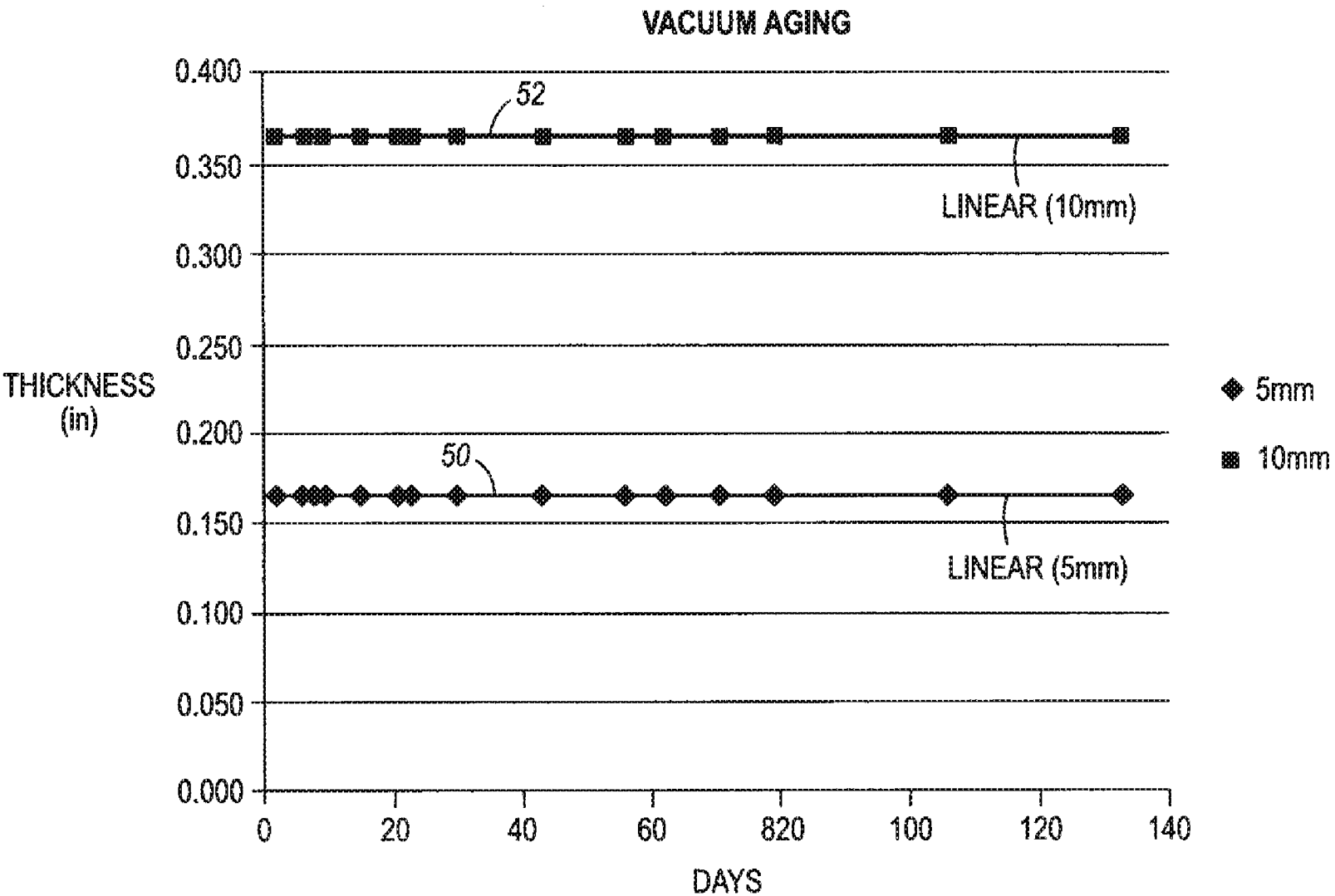
FIG. 6 shows a graph of vacuum lifetime testing.

FIG. 6 shows aging data for an insulator as shown in FIGS. 3 and 4. The data shows the number of days for which the vacuum has held. The curve 52 is for an insulator having 10 mm thick insulation material. The curve 50 is for an insulator having 5 mm thick insulation material. The thickness on the y-axis is the thickness of the material after compression from the vacuum. As the vacuum degrades, the material becomes thicker, and as the insulators do not plastically deform and exert a high load reacting against the vacuum seal forces. As can be seen, the heat seal for these insulators has held for over 130 days with very stable thickness, meaning that the seal is holding the vacuum.

In this manner, one can have the advantages of using aerogels under vacuum as insulators while not suffering the consequences of their high particle generation. The embodiments described here allow for customizable sizes and shapes of insulators with good thermal conductivity with a relatively small adjustment in the manufacturing process.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A printer, comprising an ink supply;

a print head arranged to receive ink from the ink supply and configured to receive electrical signals from a controller and to dispense ink in accordance with the electrical signals onto a print substrate; and an insulator to absorb heat from the print head, the insulator comprising:

at least two portions, a first portion residing adjacent the print head during all modes of operation and a second portion that moves adjacent the print head during a sleep mode;

an insulation material;

a filter arranged to encase the insulation material, the filter of a material that prevents escape of the insulation material while allowing air to pass through; and a container arranged to encase the filter, the container being heat sealable.

2. The printer of claim 1, the printer further comprising a solid ink printer.

3. The printer of claim 2, the printer further comprising at least one heater arranged to melt the solid ink into liquid ink and the insulator arranged to absorb heat from the heater.

4. The printer of claim 1, wherein the filter comprises a heat sealable material.

5. The printer of claim 1, wherein the insulation material comprises an aerogel.

6. The printer of claim 5, wherein the aerogel is one of an aerogel blanket, a silica aerogel, and a silica aerogel having refractory oxides and glass fibers.

7. The printer of claim 1, wherein the filter comprises a polyethylene terephthalate mesh.

* * * * *